US007444773B2

(12) United States Patent
Kolodziejczak, Sr.

(10) Patent No.: US 7,444,773 B2
(45) Date of Patent: Nov. 4, 2008

(54) POINT OF PURCHASE DISPLAY

(75) Inventor: Patrick J. Kolodziejczak, Sr., Brighton, MI (US)

(73) Assignee: EPI Printers, Inc., Battle Creek, MI (US)

( * ) Notice: Subject to any disclaimer, the term of this patent is extended or adjusted under 35 U.S.C. 154(b) by 529 days.

(21) Appl. No.: 11/282,364

(22) Filed: Nov. 18, 2005

(65) Prior Publication Data

US 2006/0107569 A1 May 25, 2006

Related U.S. Application Data

(60) Provisional application No. 60/630,542, filed on Nov. 23, 2004.

(51) Int. Cl.
*G09F 21/04* (2006.01)

(52) U.S. Cl. ..... 40/591; 40/607.14; 40/611.06; 296/37.6; 108/44; 108/47

(58) Field of Classification Search ..... 40/584, 40/587, 591, 607.14, 611.06, 586; 280/769; 296/21, 22, 37.6; 108/44, 47, 46, 48; 248/229.15, 248/229.25, 228.6, 231.71; 224/402, 403
See application file for complete search history.

(56) References Cited

U.S. PATENT DOCUMENTS 1,813,557 A * 7/1931 Zadek ..... 40/611.06
1,880,828 A * 10/1932 Courtenay ..... 40/611.05
2,787,433 A * 4/1957 Slavsky et al. ..... 248/231.71
3,120,069 A * 2/1964 Pfaff, Jr. et al. ..... 40/624
3,161,973 A 12/1964 Hastings
3,559,322 A * 2/1971 Nickel ..... 40/587
3,782,766 A 1/1974 Teel
4,858,796 A * 8/1989 Roth ..... 224/482
5,755,411 A * 5/1998 Strong et al. ..... 248/118
6,467,417 B1 10/2002 Guyot et al.
2002/0184802 A1* 12/2002 Gravitt et al. ..... 40/455
2004/0163291 A1 8/2004 Pena
2006/0191180 A1* 8/2006 Williams et al. ..... 40/591
2006/0242871 A1* 11/2006 Kondo et al. ..... 40/446

* cited by examiner

*Primary Examiner*—Gary C Hoge
(74) *Attorney, Agent, or Firm*—Flynn, Thiel, Boutell & Tanis, P.C.

(57) ABSTRACT

A point of purchase display includes a frame having left and right legs and upper and lower cross-beams. Each leg has upper and lower portions joined at an angle. The right and left legs are parallel to each other and are joined by a center cross-beam and the upper and lower cross-beams. Upper and lower display inserts are connected to the frame and fitted in the voids defined by the center cross-beam and the upper or lower cross-beam, and the upper or lower portions of the right and left legs, respectively. Upper and lower retaining members detachably connect to the right and left legs for securing the upper and lower inserts to the frame. An electronic display unit with a multiple source power supply is mounted to one of the upper and lower display inserts. A connection assembly attaches the display to the truck bedside.

3 Claims, 3 Drawing Sheets

POINT OF PURCHASE DISPLAY

CROSS REFERENCE TO RELATED APPLICATIONS

This application claims the benefit of U.S. Provisional Application Ser. No. 60/630,542, filed Nov. 23, 2004, which is incorporated herein in its entirety.

FIELD OF THE INVENTION

The invention relates to merchandise information displays. More specifically, the invention relates to a merchandise information display configured for removably mounting to the merchandise, such as a motor vehicle.

BACKGROUND OF THE INVENTION

Point of purchase displays are commonly used in retail settings in the form of posters or kiosks situated in the vicinity of the merchandise on display, such as motor vehicles on display in a dealership showroom. Due to floor space constraints, however, and in the interest of providing traffic flow around the vehicles, these informational displays can often be placed out of the way or remotely from the vehicle. In such a sub-optimal placement, the dealership loses the advantage of having the information in front of the customer. A poster or window sticker can provide some coverage, but the dealership might want to display something more substantial on the vehicle. Such a display should be properly supported on the vehicle so as to prevent damage to the vehicle.

It would be advantageous to provide a point of purchase display that is configured for ready and secure attachment to the merchandise, such as a motor vehicle. It would be further advantageous to provide a point of purchase display that is also adaptable for mounting to other fixed structure in proximity to the vehicle.

SUMMARY OF THE INVENTION

A point of purchase display includes a frame having left and right legs and upper and lower cross-beams. Each leg has upper and lower portions joined at an angle. The right and left legs are parallel to each other and are joined by a center cross-beam and the upper and lower cross-beams. Upper and lower display inserts are connected to the frame and fitted in the voids defined by the center cross-beam and the upper or lower cross-beam, and the upper or lower portions of the right and left legs, respectively. Upper and lower retaining members detachably connect to the right and left legs for securing the upper and lower inserts to the frame. An electronic display unit with a multiple source power supply is mounted to one of the upper and lower display inserts. A connection assembly attaches the display to the truck bedside.

DETAILED DESCRIPTION OF THE PREFERRED EMBODIMENT OF THE INVENTION

Figure 1:
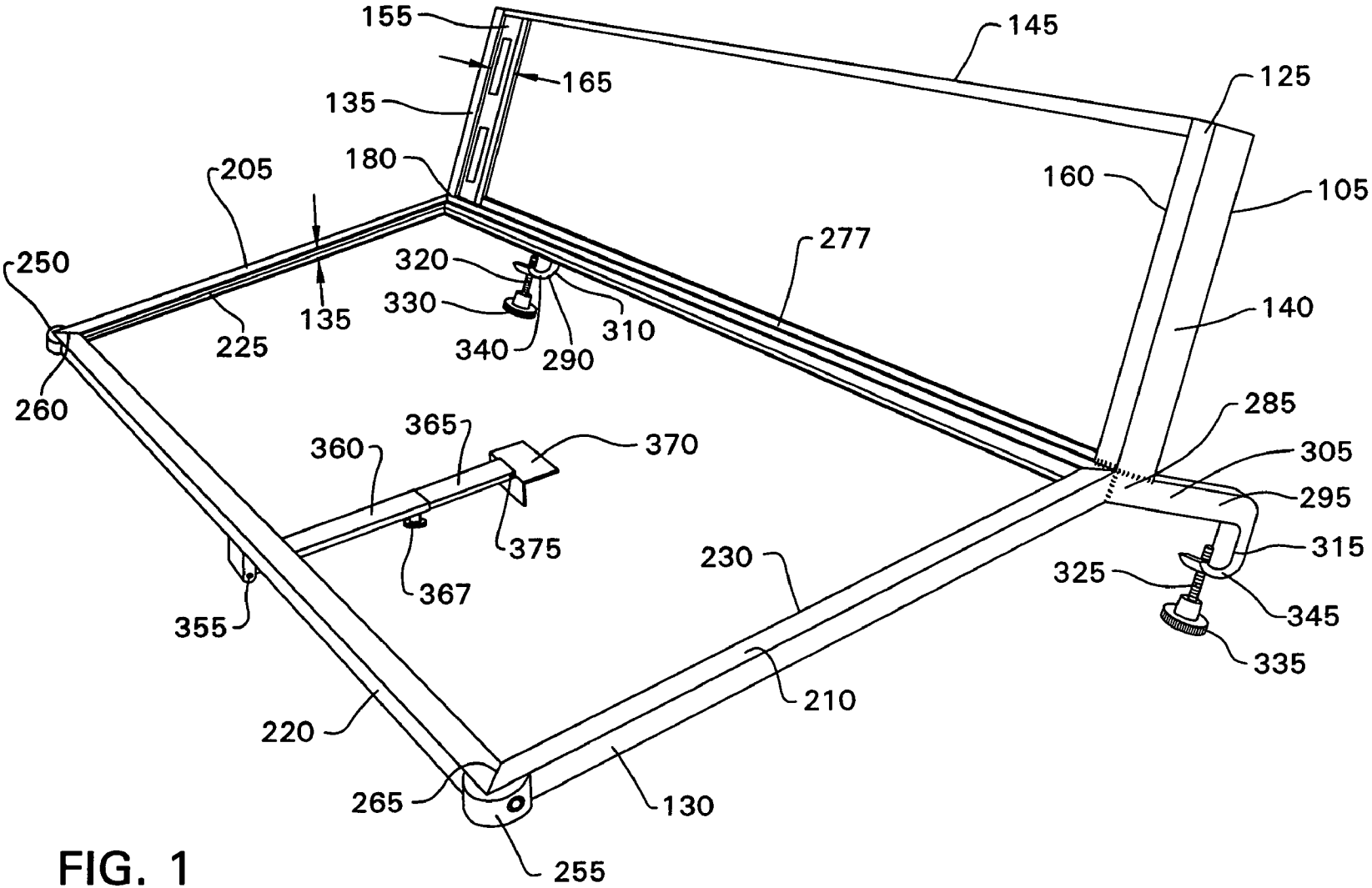
FIG. 1 is a perspective view of a frame of a point of purchase display according to the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

Figure 2:
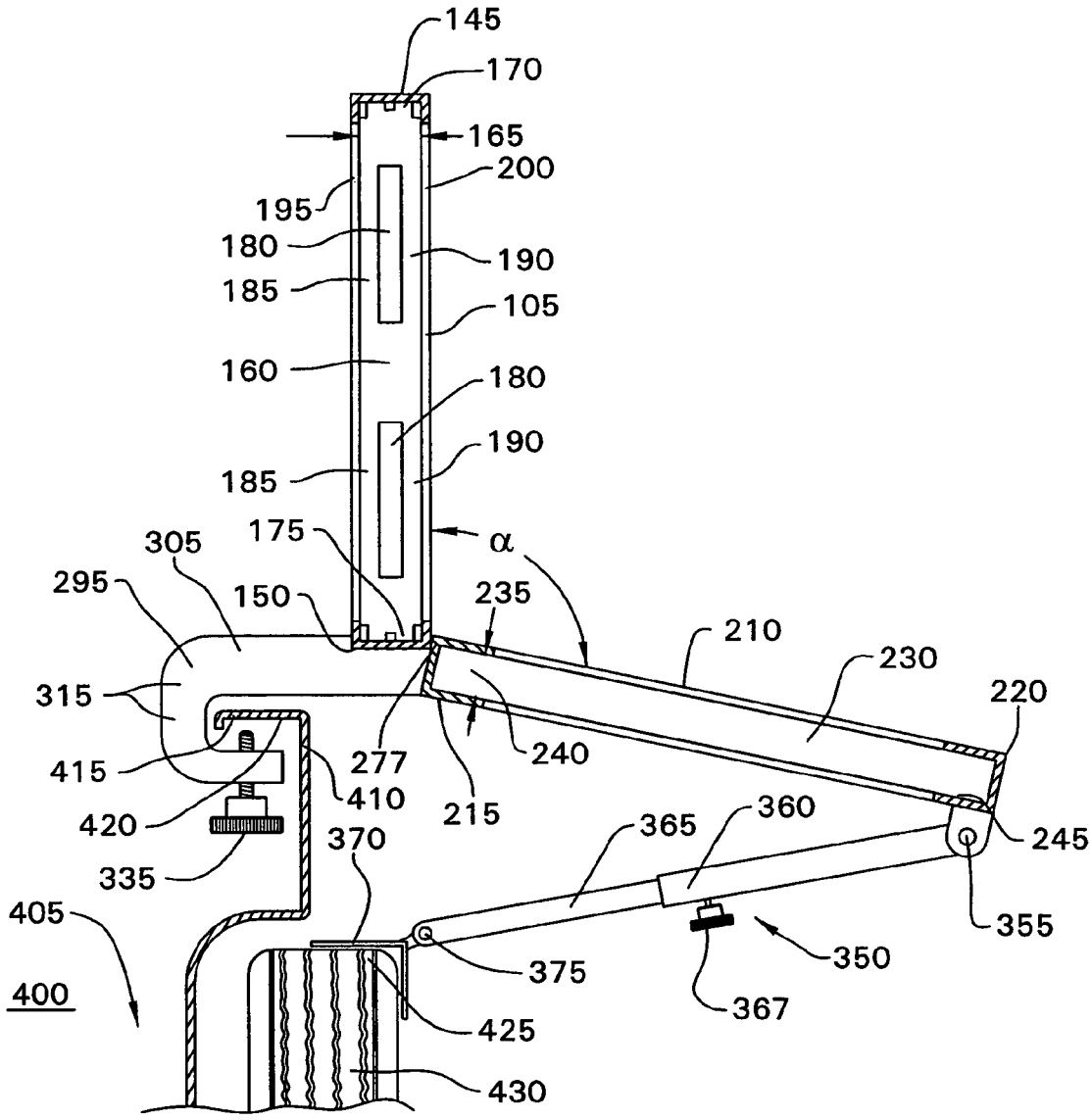
FIG. 2 is a cross-sectional view of the point of purchase display of FIG. 1 mounted on a truck.
Figure 3:
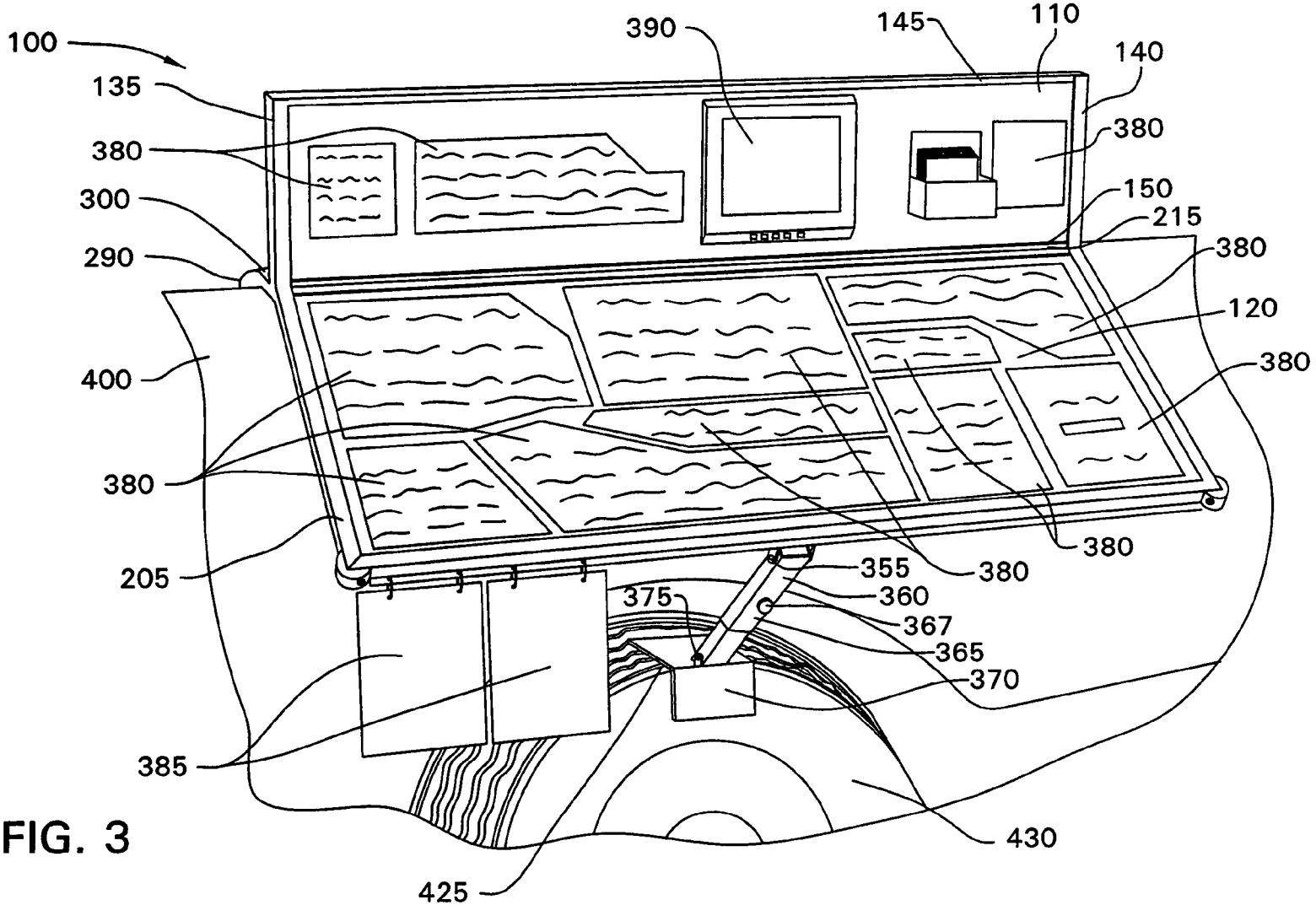
FIG. 3 is a perspective view of a point of purchase display of FIGS. 1-2 mounted on a truck.

Referring to FIGS. 1-3, a point of purchase display 100 according to the invention includes a frame 105 and a pair of upper panels 110 and a lower panel 120 slidably received in the frame 105. The upper panels 110 are received in an upper frame portion 125. The lower panel 120 is received in a lower frame portion 130.

The upper frame portion 125 includes a left upright member 135, a right upright member 140, an upper horizontal member 145 and a lower horizontal member 150. The left and right upright members 135, 140 are each in the form of a channel 155, 160 having a width 165. The channels 155, 160 of the upright members 135, 140 face inwardly toward each other from opposite sides of the upper frame portion 125. The upper and lower horizontal members 145, 150 also each include a channel 170, 175 having a width 165. The channels 170, 175 face inwardly toward each other.

Each of the channels 155, 160, 170, 175 includes a plurality of spacers 180 fixed therein. The spacers 180 are centered within each channel 155, 160, 170, 175. With reference to the left upright member 135, the spacers 180 are dimensioned so that a gap 185, 190 is formed between each spacer 180 and each of a pair of channel sidewalls 195, 200. The gaps 185, 190 are configured to closely receive one of the upper panels 110 so that the spacers 180 hold the upper panels 110 against the sidewalls 195, 200. The right upright member 140 and the upper and lower horizontal members 145, 150 are similarly configured, and cooperate with the left upright member to hold the upper panels 110 within the upper frame portion 125. The upper horizontal member 145 is removably attached to the left and right upright members 135, 140. With the upper horizontal member 145 removed, the upper panels 110 can be inserted between the left and right upright members 135, 140, through the gaps 185 in the channels 155, 160, and into the channel 175 of the lower horizontal member 150. The upper horizontal member 145 can then be reattached to the left and right upright members 135, 140.

The lower frame portion 130 includes a left side member 205, a right side member 210, an upper horizontal member 215 and a lower horizontal member 220. The left and right side members 205, 210 are each in the form of a channel 225, 230 having a width 235. The channels 225, 230 of the side members 205, 210 face inwardly toward each other from opposite sides of the lower frame portion 130. The upper and lower horizontal members 215, 220 also each include a channel 240, 245 having a width 235. The channels 240, 245 face inwardly toward each other.

Each of the channels 225, 230, 240, 245, having a width 235, is configured to closely receive the lower panel 120. The lower horizontal member 220 is removably attached to the left and right side members 205, 210. With the lower horizontal member 220 removed, the lower panel 120 can be inserted between the left and right side members 205, 210 and into the channel 240 of the upper horizontal member 215, then the lower horizontal member 220 can be reattached to the left and right side members 205, 210. A resilient bumper 250, 255 is attached at each lower corner 260, 265 of the lower frame portion 130.

The upper and lower frame portions 125, 130 intersect at an angle α. The upper horizontal member 215 of the lower frame portion 130 is closely mated with and parallel to the lower horizontal member 150 of the upper frame portion 125, and can be formed integrally therewith to form a central member 277. The upright members 135, 140 of the upper frame portion 125 and the side members 215, 220 of the lower frame portion 130 intersect at a joint 280, 285 forming the angle α, and can be integrally formed or permanently fixed, such as by welding.

A mounting assembly 290, 295 extends rearwardly from each of the left and right upright members 135, 140 proximate each joint 280, 285. Each mounting assembly 290, 295 includes a horizontal leg 300, 305 extending generally perpendicularly to the left and right upright members 135, 140. The horizontal leg 300, 305 terminates in a depending "J" or "L"-shaped, inwardly directed hook 310, 315. A threaded fastener 320, 325 having a handle 330, 335 is received in a threaded aperture (not shown) in a lower portion 340, 345 of each hook 310, 315.

A brace 350 is pivotally attached to the lower horizontal member 220 of the lower frame portion 130 at an upper pivot 355. The brace 350 includes an upper elongate member 360 and a lower elongate member 365 slidably connected to the upper elongate member 360 to make the brace 350 adjustable in length. The upper and lower elongate members 360, 365 are releasably secured together by a friction connector 367. An angle bracket 370 is pivotally mounted to the lower elongate member 365 at a lower pivot 375.

The upper panels 110 and lower panel 120 are configured to display pictorial, textual and exemplary information and models 380, 385. In one embodiment, an electronic display 390, such as an integrated video player, can be provided, especially in the upper frame portion 130. The upper frame portion 130, being configured to carry the two upper panels 110, is thicker than the lower frame portion 135 and can conceal the thickness of the electronic display 390, and the cavity formed between the upper panels 110 can provide a channel for routing any necessary wiring, such as for power or sound. The electronic display 390 is provided with a multiple voltage power supply (not shown). The electronic display 390 can thus be powered by a vehicle 12V DC power supply when the point of purchase display 100 is mounted on a vehicle, or it can be connected to 120V AC when such is available.

METHOD OF USE

Referring specifically to FIG. 3, the point of purchase display 100 according to the invention is configured for removable attachment to a pickup truck 400. Specifically, the pickup truck 400 includes a bed 405 having a sidewall 410. The sidewall 410 includes an inwardly turned top rail 415.

The point of purchase display 100 is installed on the truck 400 by placing the horizontal leg 300, 305 of the mounting assembly 290, 295 proximate the top rail 415. The display 100 is then moved outwardly over the sidewall 410 so that lower portion 340, 345 of each hook 310, 315 passes underneath the top rail 415. The installer can then grasp each of the handles 330, 335 to tighten the threaded fasteners 320, 325 against an underside 420 of the top rail 415. Each mounting assembly 290, 295 is thereby clamped to the top rail 415, and the point of purchase display 100 is secured to the top rail in a cantilever fashion.

In order to provide additional support to the point of purchase display 100, the brace 350 is provided. The angle bracket 370 of the brace 350 is configured for resting on an upper portion 425 of a vehicle tire 430. The brace 350 is adjusted in length so that the angle bracket 370 is firmly engaged with the vehicle tire 430, then the friction connector 367 between the upper and lower elongate members 360, 365 is secured. The pivot 355 and the lower pivot 375 are configured to permit the brace 350 to pivot relative to the lower frame portion 130 and the angle bracket 370 to pivot relative to the lower elongate member 365 so that the angle bracket 370 can squarely engage the tire 430; this enables the point of purchase display 100 to be mounted on pickup trucks 400 having different or variable ride heights, or distance from the top rail 415 to the tire 430.

The point of purchase display 100 is also configured such it can be placed on a table, or mounted to a fixed rail mounted to the floor or the wall in a retail space. For example, if the user is displaying information about a vehicle other than a pickup truck, or is displaying information about a non-vehicle product, the display can be mounted to a support placed adjacent the vehicle or product. In this use, the electronic display 390 can be connected to the 120V AC power source as discussed above.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

PARTS LIST point of purchase display 100
frame 105
pair of upper panels 110
lower panel 120
upper frame portion 125
lower frame portion 130
left upright member 135
right upright member 140
upper horizontal member 145
lower horizontal member 150
channel 155, 160
width 165
channel 170, 175
width 165
spacers 180
gap 185, 190
channel sidewalls 195, 200
left side member 205
right side member 210
upper horizontal member 215
lower horizontal member 220
channel 225, 230
width 235
channel 240, 245
width 235 resilient bumper 250, 255
lower corner 260, 265 of the lower frame portion 130
angle α
central member 277
joint 280, 285
mounting assembly 290, 295
horizontal leg 300, 305
"J" or "L"-shaped, inwardly directed hook 310, 315
threaded fastener 320, 325
handle 330, 335
lower portion 340, 345 of each hook 310, 315
brace 350
upper pivot 355
upper elongate member 360
lower elongate member 365
friction connector 367
angle bracket 370
lower pivot 375
pictorial, textual and exemplary information and models 380, 385
electronic display 390
pickup truck 400
bed 405
sidewall 410
inwardly turned top rail 415
underside 420
upper portion 425
vehicle tire 430

What is claimed is:

1. A point of purchase display, comprising:

a frame comprising an upper frame portion and a lower frame portion joined by a central member, the upper frame portion including a left upright member, a right upright member and an upper horizontal member and the lower frame portion including a left side member, a right side member and a lower horizontal member;

a lower display panel mounted in the lower frame portion;

an upper display panel mounted in the upper frame portion and including a video display unit; and a mounting assembly attached to the frame and including a horizontal leg and a depending hook, and a threaded fastener for clamping the mounting assembly to a support structure.

2. A point of purchase display for attachment to a pickup truck bedside, comprising:

a frame comprising a left leg and a right leg, each leg having an upper portion and a lower portion, the upper and lower portions joined at an angle, the right and left legs being parallel to each other and joined by a center cross-beam, an upper cross-beam and a lower cross-beam;

a lower display insert connected to the frame and fitted in the void defined by the center cross-beam and the lower cross-beam and the lower portions of the right and left legs;

an upper display insert connected to the frame and fitted in the void defined by the center cross-beam and the upper cross-beam and the upper portions of the right and left legs;

upper and lower retaining members detachably connected to the right and left legs for securing the upper and lower inserts to the frame;

an electronic display unit with a multiple-source power supply mounted to one of the upper and lower display inserts; and a connection assembly for attaching to a truck bedside, including a horizontal leg and a depending hook portion, and a threaded fastener for clamping the connection assembly to the truck bedside.

3. A method of displaying information about an article of merchandise, comprising the steps of:

providing a point of purchase display including:

a frame comprising an upper frame portion and a lower frame portion joined by a central member, the upper frame portion including a left upright member, a right upright member and an upper horizontal member and the lower frame portion including a left side member, a right side member and a lower horizontal member;

a lower display panel mounted in the lower frame portion;

an upper display panel mounted in the upper frame portion and including a video display unit; and a mounting assembly attached to the frame and including a horizontal leg and a depending hook, and a threaded fastener for clamping the mounting assembly to a support structure;

attaching the point of purchase display to the article of merchandise;

electrically connecting the point of purchase display to the article of merchandise; and displaying an informational video about the article of merchandise.

* * * * *